US010297196B2

(12) United States Patent
Wu et al.

(10) Patent No.: US 10,297,196 B2
(45) Date of Patent: May 21, 2019

(54) PIXEL CIRCUIT, DRIVING METHOD APPLIED TO THE PIXEL CIRCUIT, AND ARRAY SUBSTRATE

(71) Applicants: BOE TECHNOLOGY GROUP CO., LTD., Beijing (CN); CHENGDU BOE OPTOELECTRONICS TECHNOLOGY CO., LTD., Chengdu, Sichuan (CN)

(72) Inventors: Yuan Wu, Beijing (CN); Fucheng Yang, Beijing (CN); Bin Ji, Beijing (CN); Luxia Jiang, Beijing (CN); Zheng Wang, Beijing (CN)

(73) Assignees: BOE TECHNOLOGY GROUP CO., LTD., Beijing (CN); CHENGDU BOE OPTOELECTRONICS TECHNOLOGY CO., LTD., Chengdu, Sichuan (CN)

( * ) Notice: Subject to any disclaimer, the term of this patent is extended or adjusted under 35 U.S.C. 154(b) by 65 days.

(21) Appl. No.: 15/537,611

(22) PCT Filed: Sep. 9, 2016

(86) PCT No.: PCT/CN2016/098577
§ 371 (c)(1),
(2) Date: Jun. 19, 2017

(87) PCT Pub. No.: WO2017/173780
PCT Pub. Date: Oct. 12, 2017

(65) Prior Publication Data

US 2018/0137817 A1 May 17, 2018

(30) Foreign Application Priority Data

Apr. 7, 2016 (CN) ..... 2016 1 0214028

(51) Int. Cl.
*G09G 3/3233* (2016.01)
*G09G 3/3258* (2016.01)
(Continued)

(52) U.S. Cl.
CPC ..... *G09G 3/3233* (2013.01); *G09G 3/3258* (2013.01); *G09G 3/3266* (2013.01);
(Continued)

(58) Field of Classification Search
USPC ..... 345/215
See application file for complete search history.

(56) References Cited

U.S. PATENT DOCUMENTS

2007/0040770 A1* 2/2007 Kim ..... G09G 3/3233 345/76
2008/0211747 A1* 9/2008 Kim ..... G09G 3/3233 345/76
(Continued)

FOREIGN PATENT DOCUMENTS

CN 101256732 A 9/2008
CN 102063861 A 5/2011
(Continued)

OTHER PUBLICATIONS

The Third Chinese Office Action dated Dec. 4, 2017; Appln. No. 201610214028.4.
(Continued)

*Primary Examiner* — Chineyere D Wills-Burns
(74) *Attorney, Agent, or Firm* — Ladas & Parry LLP; Loren K. Thompson

(57) ABSTRACT

A pixel circuit, a driving method, and array substrate, the pixel circuit includes a plurality of sub-pixel units each of which includes an input sub-circuit, a driving sub-circuit, a light emitting control sub-circuit, and a level maintaining sub-circuit; the input sub-circuit is connected to a data line;
(Continued)

the driving sub-circuit outputs a driving current to the light emitting control sub-circuit via a second node under control of a first node; the light emitting control sub-circuit drives a light emitting element to emit light according to a received driving current under control of a light emitting control line; and the level maintaining sub-circuit is connected between the first node and a first voltage terminal to maintain a level at the first node.

18 Claims, 14 Drawing Sheets

(51) Int. Cl.
*G09G 3/3291* (2016.01)
*G09G 3/3266* (2016.01)

(52) U.S. Cl.
CPC ... *G09G 3/3291* (2013.01); *G09G 2300/0819* (2013.01); *G09G 2300/0842* (2013.01); *G09G 2300/0861* (2013.01); *G09G 2310/0262* (2013.01); *G09G 2310/0297* (2013.01); *G09G 2320/043* (2013.01); *G09G 2320/045* (2013.01)

(56) References Cited

U.S. PATENT DOCUMENTS

2009/0243977 A1* 10/2009 Chung ..... G09G 3/3233 345/76
2011/0115835 A1* 5/2011 Lee ..... G09G 3/3233 345/691
2012/0001893 A1* 1/2012 Jeong ..... G09G 3/3233 345/213
2013/0088417 A1* 4/2013 Kim ..... G09G 3/3233 345/82
2015/0028762 A1* 1/2015 Qi ..... G09G 3/3233 315/210
2015/0262526 A1* 9/2015 Park ..... G09G 3/3233 345/76
2016/0140897 A1* 5/2016 Park ..... G09G 3/3225 345/77
2016/0284274 A1 9/2016 Tan et al.
2016/0300532 A1 10/2016 Tan et al.

FOREIGN PATENT DOCUMENTS

CN 102314829 A 1/2012
CN 104036724 A 9/2014
CN 104123912 A 10/2014
CN 104485071 A 4/2015
CN 105761674 A 7/2016
EP 1785980 A2 5/2007
EP 1785980 B1 5/2007

OTHER PUBLICATIONS

International Search Report and Written Opinion of the International Searching Authority dated Dec. 28, 2016; PCT/CN2016/098577.
The First Chinese Office Action dated Feb. 6, 2017; Appln. No. 201610214028.4.
The Second Office Action dated Jun. 14, 2017; Appln. No. 201610214028.4.

* cited by examiner

PIXEL CIRCUIT, DRIVING METHOD APPLIED TO THE PIXEL CIRCUIT, AND ARRAY SUBSTRATE

TECHNICAL FIELD

The present disclosure relates to the field of displaying technology, and more particularly, to a pixel circuit for driving a light emitting element to emit light for displaying, a driving method applied to the pixel circuit, and an array substrate comprising the pixel circuit.

BACKGROUND

Along with technological progress, the AMOLED (Active Matrix Organic Light Emitting Diode) display, as an up-to-date displaying technique, has many advantages such as high luminance, broad color gamut, wide viewing angle, fast response, and small volume. The AMOLED display utilizes an organic light emitting diode as a light emitting element, which emits light for displaying under control of a driving current provided by a pixel circuit, and luminance of thereof depends on a magnitude of the current flowing through the organic light emitting diode per se.

In order to realize the color displaying, a pixel array is arranged on an array substrate of the OLED display. Each pixel dot typically includes three primary sub-pixels of red, green, and blue (RGB), respective sub-pixels are driven by separate driving circuits, and a variety of colors can be displayed on the display by using color synthesis of the three primary colors. According to a known display driving solution, respective sub-pixels at each pixel dot are driven and controlled by adopting different signals; however, since wiring layout can result in different delays in control signals for the respective sub-pixels, causing the negative impact on timing relationship among them, which deteriorates the display quality.

In addition, different from the mechanism in which the LCD (Liquid Crystal Display) uses a voltage to control luminance of a light emitting transistor, the OLED display is driven by the current and it requires a stable current to control luminance of the light emitting diode. However, in the conventional driving circuit, due to manufacturing process and aging of elements, threshold voltages of driving transistors at respective pixel dots for driving light emitting diodes have non-uniformity, the threshold voltages may vary during displaying, as such, even if the same driving voltage is applied to gates of the respective driving transistors, currents that flow through the respective OLEDs may be different, thereby affecting the display effect.

SUMMARY

In view of the above, principles of the present disclosure propose integrating a plurality of sub-pixel units and adopting a compensating manner to eliminate the effect of the drifting of threshold voltage of the driving transistor on an operating current of the light emitting diode, so that light emitting of the OLED is independent of the threshold voltage of the driving transistor, and it is ensured that no driving current flows through the OLED except in a light emitting period, guaranteeing a low luminance in a dark state of the display and a good display quality According to an aspect of the present disclosure, there is provided a pixel circuit, comprising a plurality of sub-pixel units each of which comprises an input sub-circuit, a driving sub-circuit, a light emitting control sub-circuit, and a level maintaining sub-circuit, wherein the input sub-circuit is connected to a data line and configured to supply a data signal on the data line to an input terminal of the driving sub-circuit under control of a first scan line; the driving sub-circuit is configured to receive a data signal inputted from the input sub-circuit and output a driving current to the light emitting control sub-circuit via a second node under control of a first node; the light emitting control sub-circuit is configured to drive a light emitting element to emit light according to a received driving current under control of a light emitting control line; and the level maintaining sub-circuit is connected between the first node and a first voltage terminal and is configured to maintain a level at the first node.

Optionally, according to an embodiment of the present disclosure, each sub-pixel unit further comprises a threshold voltage compensating sub-circuit, which is connected between the first node and the second node, and is configured to compensate for a threshold voltage of the driving sub-circuit under control of the first scan line.

Optionally, each sub-pixel unit further comprises a first initializing sub-circuit, which is configured to initialize the first node under control of a second scan line.

Optionally, each sub-pixel unit further comprises a second initializing sub-circuit, which is configured to initialize the second node under control of a third scan line.

Optionally, respective sub-pixel units are connected to an initializing level input terminal via first initializing sub-circuits connected in series with each other.

Optionally, respective sub-pixel units are connected to the initializing level input terminal via second initializing sub-circuits connected in series with each other.

Optionally, respective sub-pixel units are connected to the first voltage terminal via a charging sub-circuit.

Optionally, the input sub-circuit comprises a first transistor, wherein a first electrode of the first transistor is connected to the data line, a control electrode of the first transistor is connected to the first scan line, and a second electrode of the first transistor is connected to the input terminal of the driving sub-circuit.

Optionally, the driving sub-circuit comprises a second transistor, wherein a first electrode of the second transistor is connected to the input terminal of the driving sub-circuit, a control electrode of the second transistor is connected to the first node, and a second electrode of the second transistor is connected to the second node.

Optionally, the light emitting control sub-circuit comprises a third transistor, wherein a first electrode of the third transistor is connected to the second node, a control electrode of the third transistor is connected to the light emitting control line, and a second electrode of the third transistor is connected to the light emitting element.

Optionally, the level maintaining sub-circuit comprises a first capacitor, wherein a first terminal of the first capacitor is connected to the first node, and a second terminal of the first capacitor is connected to the first voltage terminal.

Optionally, according to an embodiment of the present disclosure, in the sub-pixel unit, the light emitting element is an OLED, wherein an anode of the OLED is connected to the second electrode of the third transistor, and a cathode of the OLED is connected to a second voltage terminal.

Optionally, the threshold voltage compensating sub-circuit comprises a fourth transistor, wherein a gate of the fourth transistor is connected to the first scan line, a first electrode of the fourth transistor is connected to the first node, and a second electrode of the fourth transistor is connected to the second node.

Optionally, the charging sub-circuit comprises a thirteenth transistor, a first electrode of the thirteenth transistor is connected to the first voltage terminal, a control electrode of the thirteenth transistor is connected to the light emitting control line, and a second electrode of the thirteenth transistor is connected to the input terminal of the driving sub-circuit.

Optionally, the first initializing sub-circuit comprises a fourteenth transistor, wherein a control electrode of the fourteenth transistor is connected to the second scan line, and a first electrode of the fourteenth transistor is connected to the first node; the first initializing sub-circuit is configured to initialize the first node under control of the second scan line.

Optionally, the second initializing sub-circuit comprises a seventeenth transistor, wherein a control electrode of the seventeenth transistor is connected to the third scan line, and a first electrode of the seventeenth transistor is connected to the second node; the second initializing sub-circuit is configured to initialize the second node under control of the third scan line.

According to another aspect of the present disclosure, there is provided an array substrate, on which a plurality of the pixel circuits described above are arranged for driving light emitting elements to display.

According to yet another aspect of the present disclosure, there is provided a display device comprising the array substrate described above. The display device can be any product or component having a display function such as AMOLED display, television, digital photo frame, mobile phone, tablet computer, and so on.

According to yet another aspect of the present disclosure, there is provided a driving method applied to the pixel circuit described above, comprising: turning on the first initializing sub-circuit by an active level signal inputted from the second scan line, so as to initialize the first node; turning on the input sub-circuit by an active level signal inputted from the first scan line so as to supply an active data signal to the driving sub-circuit, and turning on the threshold voltage compensating sub-circuit by the active level signal inputted from the first scan line so as to compensate for a threshold voltage of the driving sub-circuit; turning on the second initializing sub-circuit by an active level signal inputted from the third scan line so as to initialize the second node; and turning on the charging sub-circuit and the light emitting control sub-circuit by an active level signal inputted from the light emitting control signal line so as to drive the light emitting element to emit light.

Optionally, the driving method according to the present disclosure as described above further comprises: when the active level signal is inputted to the first scan line, supplying the active data signals corresponding to respective color components to the driving sub-circuits of the sub-pixel unit separately or synchronously via the corresponding data lines.

Optionally, the driving method according to the present disclosure as described above further comprises: when the active data signals are supplied to the driving sub-circuits of the sub-pixel unit via the data lines, turning on the threshold voltage compensating sub-circuit via the active level signal inputted from the first scan line, and applying a sum of the active data signal and the threshold voltage of the driving sub-circuit to the control terminal of the driving sub-circuit.

In the pixel circuit and the driving method according to the embodiment of the present disclosure, since driving of a plurality of sub-pixels is integrated into one pixel driving circuit, the respective sub-pixels can share certain driving signals, so that the number of driving signals is reduced, wiring space of the driving circuit is saved, and system integration is improved. In addition, delays among the corresponding driving signals adopted by the respective sub-pixel circuits for displaying are eliminated, and a display quality at the time of using the respective sub-pixels to display and thereby synthesize colors is improved. Meanwhile, with the pixel circuit and the driving method of the present embodiment, it is possible to arrange more pixel dots in the case in which a size of the display panel is fixed, and thereby resolution of the display panel is improved.

In addition, in the pixel circuit and the driving method according to the embodiment of the present disclosure, when the data voltage is applied to the driving sub-circuit, the threshold voltage of the driving sub-circuit is compensated by the threshold voltage compensation sub-circuit, and the affect of the threshold voltage of the driving transistor on the operating current of the light emitting element is eliminated, and thereby display effect is enhanced.

In addition, in the pixel circuit and the driving method according to the embodiment of the present disclosure, the second node is initialized by the second initializing sub-circuit before the driving current is applied to the light emitting element, so that a leakage current of the light emitting control sub-circuit is eliminated, the light emitting element is prevented from emitting light in a dark state due to the leakage current, and thus the display quality is improved.

It is to be understood that more aspects and advantages of the present disclosure can be found below in the detailed description of the present disclosure.

BRIEF DESCRIPTION OF THE DRAWINGS

The following is a brief introduction of the drawings as an example for explaining the principles of the present disclosure. It is to be understood that the drawings illustrated are merely schematic illustration for a better understanding of the principles of the present disclosure, elements known to those skilled in the art might have been omitted, which should not be understood as intended to limit the present invention. In the drawings.

DETAILED DESCRIPTION OF THE EMBODIMENTS

Hereinafter, embodiments of the present disclosure will be described with reference to the accompanying drawings. In the following description, detailed description of known functions and configurations may be omitted for clarity and conciseness. However, this does not affect those skilled in the art to implement the embodiments of the present disclosure on the basis of the present disclosure.

Figure 1:
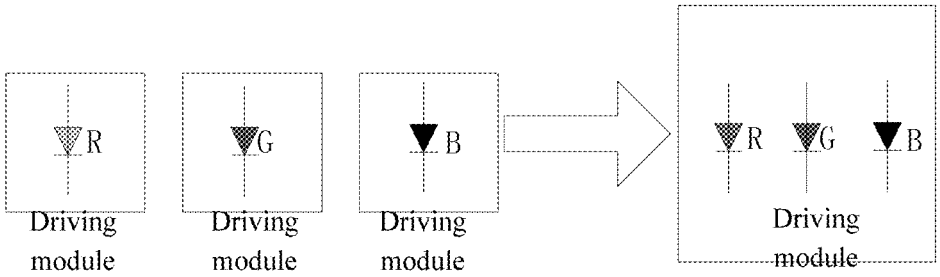
FIG. 1 is a schematic diagram of principles of the present disclosure.

According to the principles of the present disclosure, as illustrated in FIG. 1, driving circuits of a plurality of sub-pixels (e.g., three sub-pixels RGB) are integrated into one pixel driving circuit, so that the plurality of sub-pixels can be driven concurrently, and thereby the number of driving transistors and the number of signal lines for driving the sub-pixels are reduced, and the area occupied by the driving circuit is also decreased. More pixel dots can be arranged in a case in which the size of the display panel is fixed, and thus resolution of the display panel is increased. Further, compensation mechanism is introduced in the respective sub-pixel circuits, and the threshold voltages of the driving transistors in the sub-pixel units can be compensated and response characteristics of the OLEDs can be improved.

According to an embodiment of the present disclosure, there is provided a pixel circuit, comprising a plurality of sub-pixel units. FIG. 2 illustrates a schematic structure of one of the sub-pixel units, as illustrated in FIG. 2, the sub-pixel unit comprises an input sub-circuit 201, a driving sub-circuit 202, a light emitting control sub-circuit 203, and a level maintaining sub-circuit 204; wherein the input sub-circuit 201 is connected to a data line DATA and supplies a data signal on the data line to an input terminal INPUT_D of the driving sub-circuit 202 under control of a first scan line Sn; the driving sub-circuit 202 receives a data signal inputted from the input sub-circuit 201 and outputs a driving current to the light emitting control sub-circuit 203 via a second node N2 under control of a first node N1; the light emitting control sub-circuit 203 drives a light emitting element OLED to emit light according to a received driving current under control of a light emitting control line En; and the level maintaining sub-circuit 204 is connected between the first node N1 and a first voltage terminal ELVDD to maintain a level at the first node N1.

Optionally, according to an embodiment of the present disclosure, as illustrated in FIG. 2, each sub-pixel unit further comprises a threshold voltage compensating sub-circuit 205, which is connected between the first node N1 and the second node N2, and is configured to compensate for a threshold voltage of the driving sub-circuit under control of the first scan line Sn.

Optionally, as illustrated in FIG. 2, each sub-pixel unit further comprises a first initializing sub-circuit 206, which initializes the first node N1 under control of a second scan line Sn−1.

Optionally, as illustrated in FIG. 2, each sub-pixel unit further comprises a second initializing sub-circuit 207, which initializes the second node N2 under control of a third scan line Sn+1.

Figure 2A:
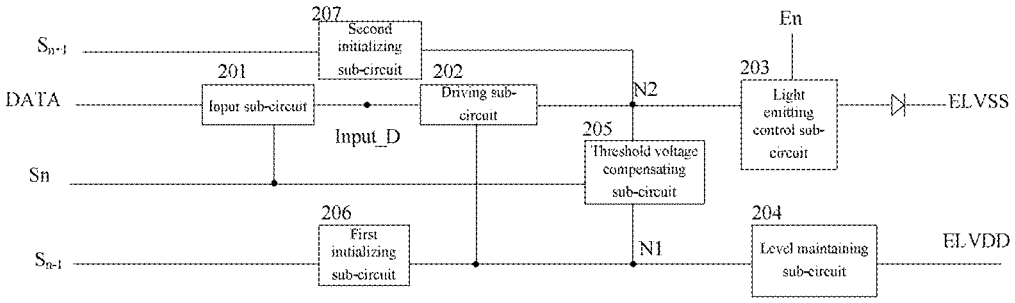
FIGS. 2*a*-2*b* illustrate a schematic structure of a pixel circuit according to an embodiment of the present disclosure.
Figure 2B:
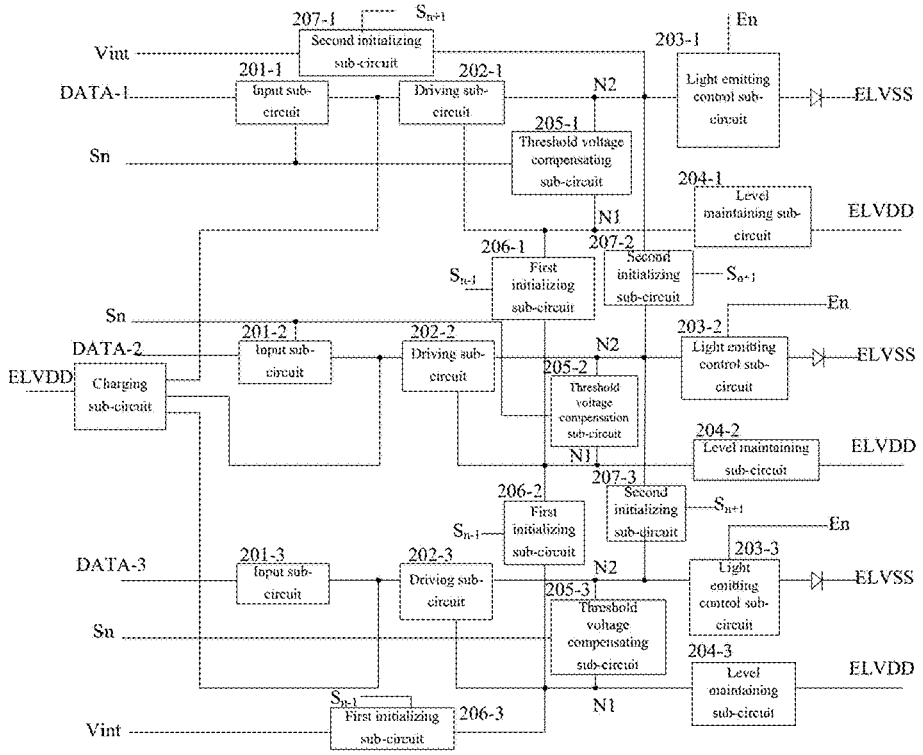

As an example, FIG. 2*b* illustrates a case where the pixel circuit comprises three sub-pixel units, wherein structure of each sub-pixel unit is the same as that illustrated in FIG. 2*a*. In addition, as illustrated in FIG. 2*b*, optionally, driving sub-circuits 202-1, 202-2, and 202-3 of respective sub-pixel units are connected to the first voltage terminal ELVDD via a charging sub-circuit 208.

Optionally, as illustrated in FIG. 2*b*, first nodes N1 of respective sub-pixel units are connected to an initializing level input terminal Vint via first initializing sub-circuits 206-1, 206-2, and 206-3 connected in series with each other.

Optionally, as illustrated in FIG. 2*b*, second nodes N2 of respective sub-pixel units are connected to an initializing level input terminal Vint via second initializing sub-circuits 207-1, 207-2, and 207-3 connected in series with each other.

In the pixel circuit according to the embodiment of the present disclosure, the driving of a plurality of sub-pixels is integrated into one pixel driving circuit, so that the respective sub-pixels can share certain driving signals, decreasing the number of driving signals, wiring space of the driving circuit, and improving the system integration. In addition, delays among the corresponding driving signals, which are introduced when the respective sub-pixel circuits adopt different driving signals for displaying, are eliminated, and a display quality at the time of using the respective sub-pixels for displaying and thereby synthesizing colors is improved.

Hereinafter, the principles of the present disclosure will be described by taking a case in which the pixel circuit comprises three sub-pixel units for displaying the three primary colors RGB respectively as an example. It should be understood that, the principles of the present disclosure are not limited to the case where the pixel circuit only comprises the sub-pixel units for three colors RGB; instead, more sub-pixel units can be included in one pixel circuit as desired. For example, in addition to three sub-pixels for three primary colors RGB, it is also possible to add a sub-pixel for a yellow color, so that one pixel circuit comprises four sub-pixel units RGBY to extend color gamut and saturation in picture displaying and improve color expression. Alternatively, in addition to the three sub-pixels for the three primary colors RGB, a sub-pixel for a white color can be added, so that one pixel circuit comprises four sub-pixel units of RGBW, thus enhancing the transmittance of the display, increasing the luminance, and reducing the energy consumption; further, the color density and brightness at a single pixel dot can be adjusted accurately, so that the levels can be distinctive, the colors can be richer and the details can be vivid while a transition color is supplemented. Thus, according to the principles of the present disclosure, no limitation is made to the number of sub-pixel units which are included in one pixel dot, the number can be flexibly adjusted according to actual requirements, which does not affect implementation of the present disclosure.

Figure 3:
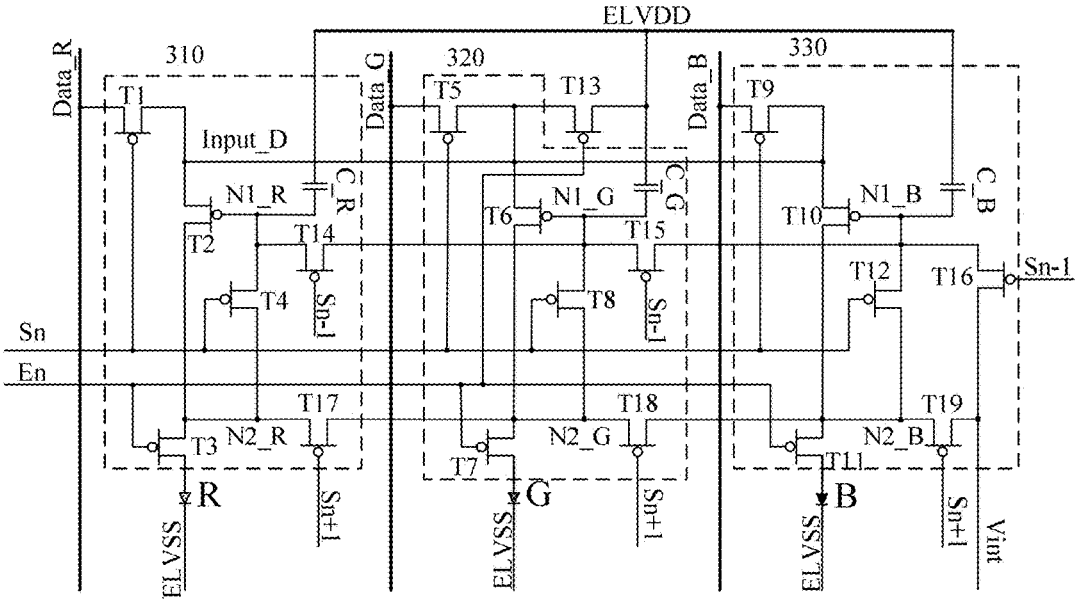
FIG. 3 illustrates a specific structure of a pixel circuit for one pixel dot according to an embodiment of the present disclosure.

FIG. 3 illustrates a schematic circuit of a pixel circuit for one pixel dot according to an embodiment of the present disclosure; as illustrated in FIG. 3, three sub-pixel units for three colors RGB are integrated into one pixel circuit, wherein three sub-pixel units 310, 320, 330 for displaying red, green, and blue components, respectively, are included and connected to data lines DATA_R, DATA_G, and DATA_B, respectively.

Taking the sub-pixel unit 310 for the red component as an example, the input sub-circuit 201 comprises a first transistor T1, wherein a first electrode of the first transistor is connected to the data line DATA_R, a control electrode of the first transistor is connected to the first scan line Sn, and a second electrode of the first transistor is connected to the input terminal INPUT_D of the driving sub-circuit.

Optionally, as illustrated in FIG. 3, in the sub-pixel unit 310, the driving sub-circuit 202 comprises a second transistor T2, wherein a first electrode of the second transistor is connected to the input terminal Input_D of the driving sub-circuit, a control electrode of the second transistor is connected to the first node N1_R, and a second electrode of the second transistor is connected to the second node N2_R.

Optionally, in the sub-pixel unit 310, the light emitting control sub-circuit 203 comprises a third transistor T3, wherein a first electrode of the third transistor T3 is connected to the second node N2_R, a control electrode of the third transistor T3 is connected to the light emitting control line En, and a second electrode of the third transistor T3 is connected to the light emitting element.

Optionally, in the sub-pixel unit 310, the level maintaining sub-circuit 204 comprises a first capacitor C_R, wherein a first terminal of the first capacitor is connected to the first node N1_R, and a second terminal of the first capacitor is connected to the first voltage terminal ELVDD.

Optionally, according to an embodiment of the present disclosure, in the sub-pixel unit, the light emitting element is an OLED, wherein the second electrode of the third transistor T3 is connected to an anode of the OLED, and a cathode of the OLED is connected to a second voltage terminal ELVSS.

Optionally, according to an embodiment of the present disclosure, the first voltage terminal ELVDD provides a high level, and the second voltage terminal ELVSS provides a low level.

Optionally, as illustrated in FIG. 3, in the sub-pixel unit 310, the threshold voltage compensating sub-circuit 205 comprises a fourth transistor T4, wherein a control electrode of the fourth transistor is connected to the first scan line Sn, a first electrode of the fourth transistor is connected to the first node N1_R, and a second electrode of the fourth transistor is connected to the second node N2_R.

Optionally, as illustrated in FIG. 3, in the sub-pixel unit 310, the first initializing sub-circuit 206 comprises a fourteenth transistor T14, wherein a control electrode of the fourteenth transistor T14 is connected to the second scan line Sn−1, and a first electrode of the fourteenth transistor T14 is connected to the first node N1_R, and the first initializing sub-circuit 206 is configured to initialize the first node N1_R under control of the second scan line Sn−1.

Optionally, as illustrated in FIG. 3, in the sub-pixel unit 310, the second initializing sub-circuit 207 comprises a seventeenth transistor T17, wherein a control electrode of the seventeenth transistor T17 is connected to the third scan line Sn+1, and a first electrode of the seventeenth transistor T17 is connected to the second node N2_R, and the second initializing sub-circuit 207 is configured to initialize the second node N2_R under control of the third scan line Sn+1.

Structures of the sub-pixel units 320 and 330 respectively for the G component and the B component are substantially the same as the structure of the sub-pixel unit 310 for the R component, and the three sub-pixel units share the first scan line Sn, the second scan line Sn−1, the third scan line Sn+1, the light-emitting control line En, the first voltage terminal ELVDD, and the second voltage terminal ELVSS; the main difference between them lies in that the input sub-circuits thereof are respectively connected to the data lines DATA_G and DATA_B so as to display different color components for the corresponding data signals; reference can be made to FIG. 3 for concrete structures, and details are not described here.

According to an embodiment of the present disclosure, in the pixel circuit, the sub-pixel units 310, 320, and 330 respectively for the RGB components are connected to the first voltage terminal ELVDD via a charging sub-circuit. Optionally, as illustrated in FIG. 3, the charging sub-circuit 208 comprises a thirteenth transistor T13, wherein a first electrode of the thirteenth transistor is connected to the first voltage terminal ELVDD, a control electrode of the thirteenth transistor T13 is connected to the light-emitting control line En, and a second electrode of the thirteenth transistor T13 is connected to the input terminal INPUT_D for the driving sub-circuits of the respective sub-pixel units.

Optionally, according to an embodiment of the present disclosure, the sub-pixel unit 310 is connected to the sub-pixel unit 320 via the first initializing sub-circuit of the sub-pixel unit 310. Specifically, the first initializing sub-circuit of the sub-pixel unit 310 is connected between the first node N1_R of the sub-pixel unit 310 and the first node N1_G of the sub-pixel unit 320. As illustrated in FIG. 3, the control electrode of the transistor T14 is connected to the second scan line Sn−1, the first electrode of the transistor T14 is connected to the node N1_R, and the second electrode of the transistor T14 is connected to the node N1_G.

Similarly, the sub-pixel unit 320 is connected to the sub-pixel unit 330 via the first initializing sub-circuit of the sub-pixel unit 320. Specifically, the first initializing sub-circuit of the sub-pixel unit 320 is connected between the first node N1_G of the sub-pixel unit 320 and the first node N1_B of the sub-pixel unit 330. As illustrated in FIG. 3, the control electrode of the transistor T15 is connected to the second scan line Sn−1, the first electrode of the transistor T15 is connected to the node N1_G, and the second electrode of the transistor T15 is connected to the node N1_B.

In addition, the sub-pixel unit 330 is connected to the initializing level input terminal Vint via the first initializing sub-circuit of the sub-pixel unit 330. Specifically, as illustrated in FIG. 3, the control electrode of the transistor T16 is connected to the second scan line Sn−1, the first electrode of the transistor T16 is connected to the first node N1_B of the sub-pixel unit 330, and the second electrode of the transistor T16 is connected to the initializing level input terminal Vint.

In such a manner in which the transistors T14, T15, and T16 are connected in series with each other, that is, the control electrodes of the three transistors T14, T15, and T16 are all connected to the second scan line Sn−1, the first and second electrodes of the transistor T14 are connected between the first node N1_R of the sub-pixel unit 310 and the first node N1_G of the sub-pixel unit 320, the first and second electrodes of the transistor T15 are connected between the first node N1_G of the sub-pixel unit 320 and the first node N1_B of the sub-pixel unit 330, and the first and the second electrodes of the transistor T16 are connected between the first node N1_B of the sub-pixel unit 330 and the initializing level input terminal Vint, the level inputted from the initializing level input terminal can be used to initialize the first nodes of the respective sub-pixel units.

Optionally, according to an embodiment of the present disclosure, the sub-pixel unit 310 is connected to the sub-pixel unit 320 via the second initializing sub-circuit of the sub-pixel unit 310. Specifically, the second initializing sub-circuit of the sub-pixel unit 310 is connected between the second node N2_R of the sub-pixel unit 310 and the second node N2_G of the sub-pixel unit 320. As illustrated in FIG. 3, the control electrode of the transistor T17 is connected to the third scan line Sn+1, the first electrode of the transistor T17 is connected to the node N2_R, and the second electrode of the transistor T17 is connected to the node N2_G.

Similarly, the sub-pixel unit 320 is connected to the sub-pixel unit 330 via the second initializing sub-circuit of the sub-pixel unit 320. Specifically, the second initializing sub-circuit of the sub-pixel unit 320 is connected to the second node N2_G of the sub-pixel unit 320 and the second node N2_B of the sub-pixel unit 330. As illustrated in FIG.

3, the control electrode of the transistor T18 is connected to the third scan line Sn+1, the first electrode of the transistor T18 is connected to the node N2_G, and the second electrode of the transistor T18 is connected to the node N2_B.

In addition, the second node N2_B of the sub-pixel unit 330 is connected to the initializing level input terminal Vint via the second initializing sub-circuit of the sub-pixel unit 330. Specifically, as illustrated in FIG. 3, the control electrode of the transistor T19 is connected to the third scan Line Sn+1, the first electrode of the transistor T19 is connected to the second node N2_B of the sub-pixel unit 330, and the second electrode of the transistor T19 is connected to the initializing level input terminal Vint.

In such a manner in which the transistors T17, T18, and T19 are connected in series with each other, i.e., the control electrodes of the three transistors T17, T18, and T19 are all connected to the third scan line Sn+1, the first and second electrodes of the transistor T17 are connected between the second node N2_R of the sub-pixel unit 310 and the second node N2_G of the sub-pixel unit 320, the first and second electrodes of the transistor T18 are connected between the second node N2_G of the sub-pixel unit 320 and the second node N2_B of the sub-pixel unit 330, and the first and second electrodes of the transistor T19 are connected between the second node N2_B of the sub-pixel unit 330 and the initializing level input terminal Vint, the level inputted from the initializing level input terminal can be used to initialize the second nodes of the respective sub-pixel units.

In the embodiment illustrated in FIG. 3, each of the transistors in the sub-pixel unit is a P-type transistor, wherein the control electrode is a gate, the first electrode is a source, and the second electrode is a drain. The transistor is turned on when a low level is applied to the gate thereof, and turned off when a high level is applied to the gate thereof.

Alternatively, each of the transistors can be an N-type transistor, wherein the control gate is a gate, the first electrode is a drain, and the second electrode is a source. The transistor is turned on when a high level is applied to the gate thereof, and turned off when a low level is applied to the gate thereof.

Of course, according to an embodiment of the present disclosure, it is possible that parts of the transistors in the sub-pixel unit can be P-type transistors, while the other transistors can be N-type transistors, and the principles of the present disclosure can also be applied as long as the level of the control signals applied to the gates thereof are changed adaptively, and the specific details are not discussed here.

The operating principle of the pixel circuit illustrated in FIG. 3 will be described in detail with reference to timing of relevant signals. First, the case in which the pixel circuit displays a single color component is described. Taking the case of displaying the green component as an example, specific operations of the pixel circuit illustrated in FIG. 3 will be described in detail with reference to FIGS. 4*a* to 7*b*.

Considering that in the present embodiment, the transistors adopted in the pixel circuits all are P-type transistors, the respective transistors will be turned on when a low level is applied to the gate and will be turned off when a high level is applied to the gate.

Figure 4A:
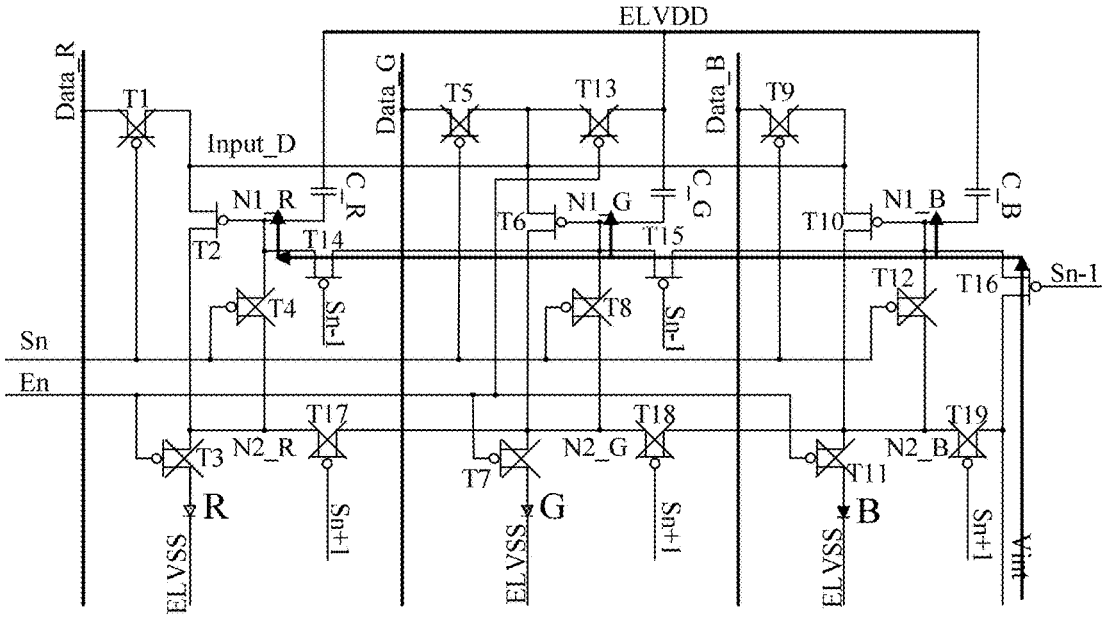
FIGS. 4*a*-7*b* illustrate circuit structure and signal timing in respective periods when a pixel circuit according to an embodiment of the present disclosure drives a single sub-pixel.
Figure 4B:
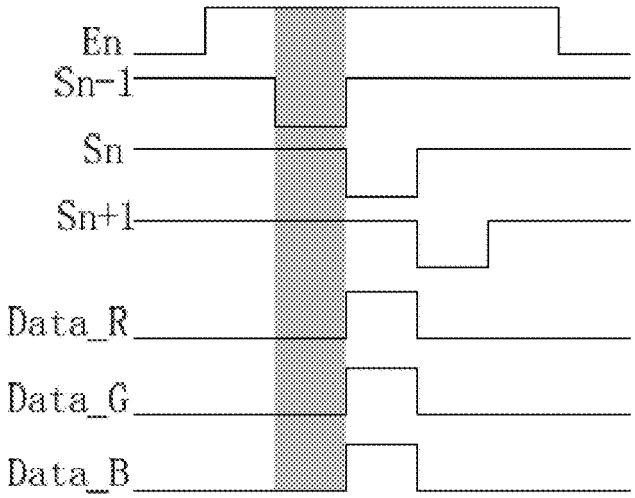

In a first period, as illustrated in FIG. 4*b*, the first scan signal Sn, the third scan signal Sn+1, and the light emitting control signal En are at a high level, and the second scan signal Sn−1 is at a low level; as illustrated in FIG. 4*a*, the transistors T14, T15, and T16 are turned on under control of the second scan signal Sn−1 at a low level, so that an initializing level inputted from the initializing level input terminal Vint is applied to the node N1_B via the turned-on transistor T16, applied to the node N1_G via the turned-on transistors T16 and T15, and applied to the node N1_R via the turned-on transistors T116, T115, and T14, and thus $V_{N1_R}=V_{N1_G}=V_{N1_B}=$Vint1. Since a low level is supplied from the initializing level input terminal Vint, the first nodes of the respective sub-pixel units are initialized to a low level, so that the driving transistors T2, T6, and T10 whose gates are connected to the first nodes are turned on.

Figure 5A:
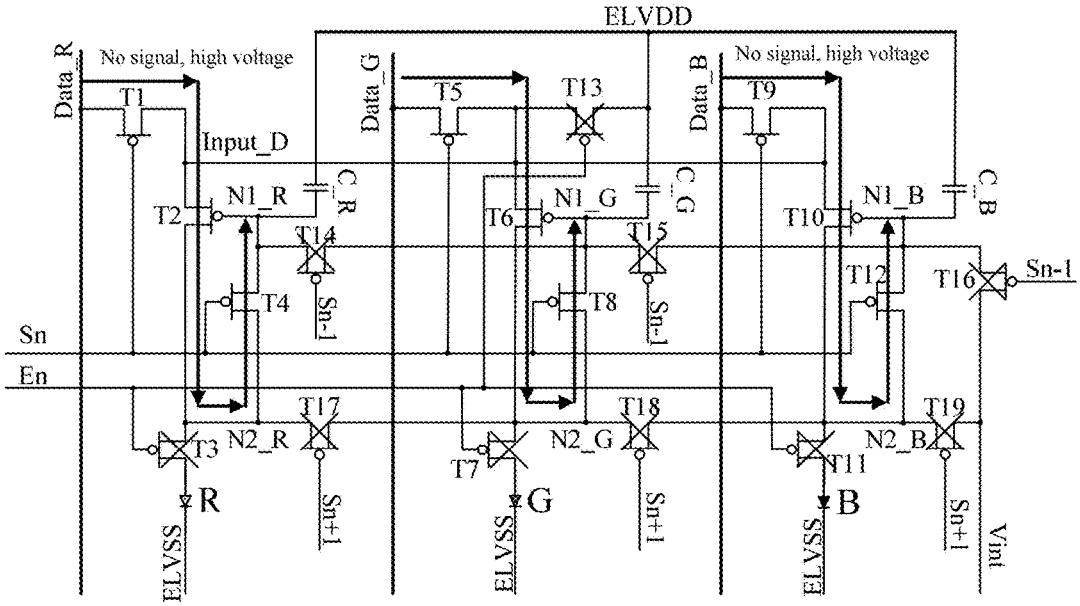
Figure 5B:
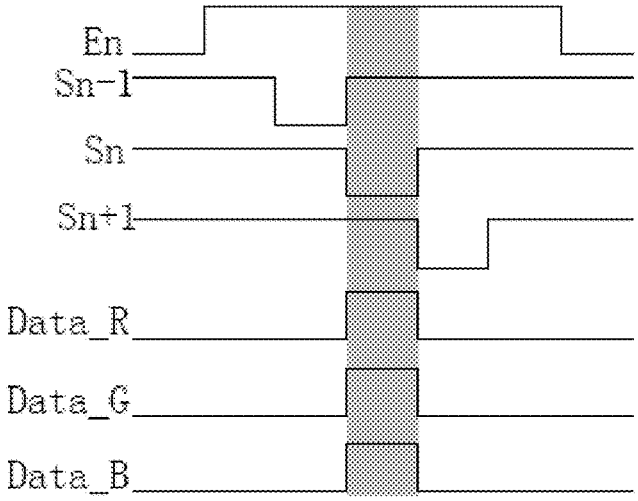

In a second period, as illustrated in FIG. 5*b*, the first scan signal Sn is at a low level, the second scan line Sn−1, the third scan signal Sn+1, and the light emitting control signal En are at a high level; thus, as illustrated in FIG. 5*a*, the transistors T14, T15, and T16 are turned off, and the threshold voltage compensating transistors T4, T8, and T12 are turned on under control of the first scan signal Sn at a low level, and the input transistors T1, T5, and T9 are turned on under control of the first scan signal Sn at a low level; the driving transistors T2, T6, and T10 are maintained in a turned-on state since the first nodes N1_R, N1_G, and N1_B are still kept at a low level. As such, the path between the gate and the drain of the driving transistor T2 conducts via the turned-on transistor T4, the path between the gate and the drain of the driving transistor T6 conducts via the turned-on transistor T8, and the path between the gate and the drain of the driving transistor T10 conducts via the turned-on transistor T12. An active data voltage signal is provided on the data line Data_G for the green component, a high voltage instead of an active data voltage is provided on the data lines Data_R and Data_B for the red and blue components respectively. In view of the fact that turn-on voltages of the input transistor and the threshold voltage compensating transistor are significantly smaller than that of the driving transistor, the voltage at the node N1_G can be expressed as $V_{th}+V_{data_G}$, where $V_{th}$ represents the threshold voltage of the driving transistor, $V_{data_G}$ represents the data signal voltage supplied from the data line Data_G, and thereby the affect of the threshold voltage $V_{th}$ of the driving transistor on the light emitting current of the OLED can be removed. Meanwhile, in this period, since a high level is provided on the data lines Data_R and Data_B, the nodes N1_R and N1_B are charged to a high level, so that the driving transistors T2 and T10 are turned off subsequently.

Figure 6A:
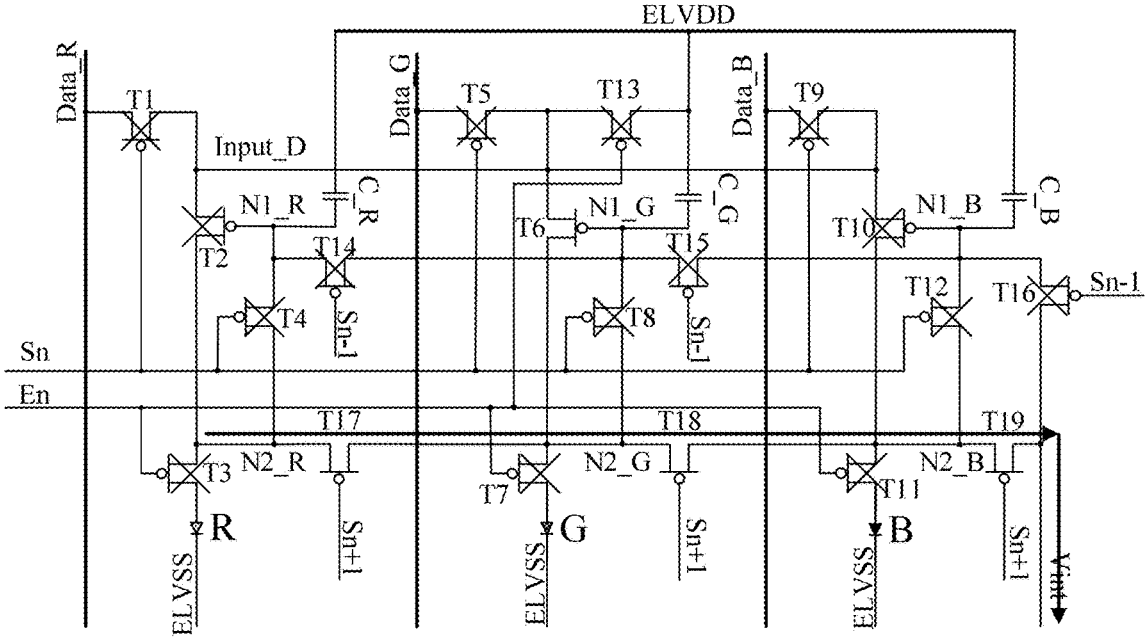
Figure 6B:
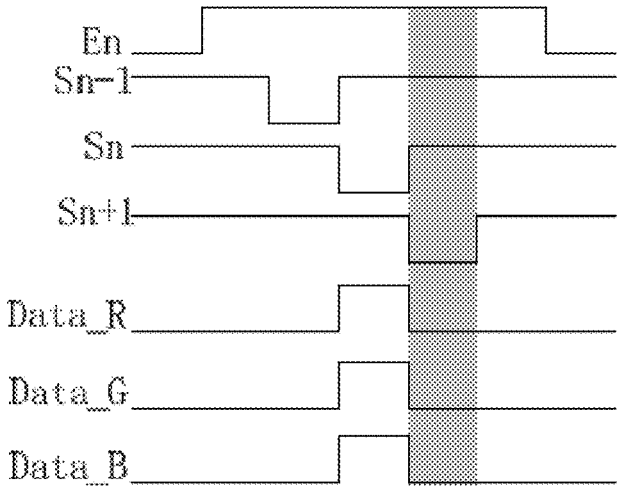

In a third period, as illustrated in FIG. 6*b*, the third scan signal Sn+1 is at a low level, the first scan line Sn, the second scan signal Sn−1, and the light emitting control signal En are at a high level; thus, as illustrated in FIG. 6*a*, the transistors T17, T18, and T19 are turned on, so that an initializing level inputted from the initializing level input terminal Vint is applied to the node N2_B via the turned-on transistor T19, applied to the node N2_G via the turned-on transistors T19 and T18, and applied to the node N2_R via the turned-on transistors T19, T18, and T17, and thus $V_{N2_R}=V_{N2_G}=V_{N2_B}=$Vint2. In this period, the driving transistor T6 continues to be maintained on. Initializing the second nodes N2_B, N2_G, and N2_R can enable the light emitting element to be maintained in a dark state before an active light emitting control signal arrives. The light emitting control signal is at a high level in this period and not in an active level state, and the light emitting control transistors T3, T7, and T11 should be in a turned-off state, so that no current flows through the light emitting element OLED and the OLED would be in a dark state without illumination ideally. However, due to manufacturing process and aging of devices etc., it is possible that there is a small amount of leakage current flowing through the light emitting control transistor when its gate is at a high level, i.e., at an inactive level, which causes the corresponding light emitting element OLED to emit a weak light in a dark state, thus deteriorating the display quality. Therefore, the source potential of the light emitting control transistor is reduced by applying the low level to the second nodes N2_R, N2_G, and N2_B from the initializing level input terminal Vint via the second initializing transistors T17, T18, and T19 to perform the initialization, thereby effectively reducing or even eliminating the possible leakage current, so that the light emitting element emits no light in a dark state. When the first node and the second node are initialized, the initializing levels Vint1 and Vint2 provided at the initializing level input terminal can be different from each other depending on the actual situation, so long as it is guaranteed that the driving transistor can be turned on in the first period, and that the source potential of the light emitting control transistor can be reduced effectively in the third period to ensure that the light emitting element does not emit light.

Figure 7A:
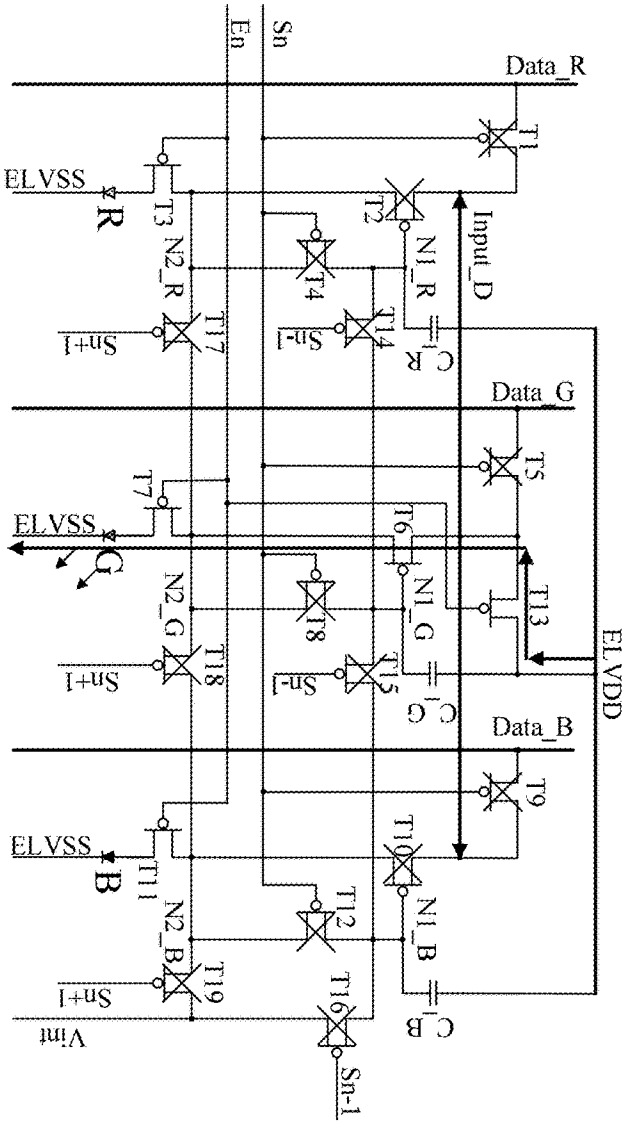
Figure 7B:
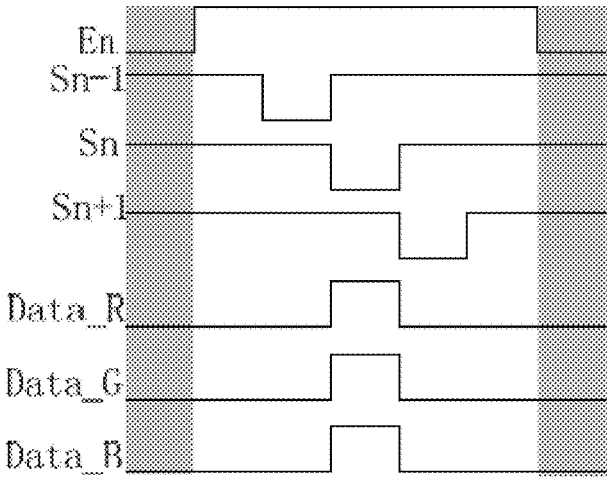

In a fourth period, as illustrated in FIG. 7*b*, the first scan signal Sn, the second scan line Sn−1, and the third scan signal Sn+1 are at a high level, and the light emitting control signal En is at a low level; thus, as illustrated in FIG. 7*a*, the transistors T17, T18, and T19 are turned off, and the light emitting control transistors T3, T7, and T11 are turned on under control of the low-level light emitting control signal. Since the levels at the first nodes N1_R and N1_B are maintained at a high level, the driving transistor T2 and T10 are maintained off, and the light emitting elements OLED_R and OLED_B emit no light; the driving transistor T6 continues to be maintained on, and the charging transistor T13 is turned on under control of the low-level light emitting control signal, and thereby the charging transistor T13, the driving transistor T6, and the light emitting control transistor T7 form a path through which the driving current can be applied to the light emitting element OLED_G, for driving the light emitting element OLED_G to emit light.

In the case of using the driving transistor to drive the OLED, the operating current for driving the OLED can be expressed as $I_{OLED}=K(V_{gs}-V_{th})^2$ where $V_{gs}$ represents a gate-source voltage of the driving transistor, $V_{th}$ represents the threshold voltage of the driving transistor. K represents a coefficient and can be expressed as $K=\mu\cdot C_{ox}W/L$; where μ represents carrier mobility, $C_{ox}$ represents gate oxide layer capacitance, and W/L represents a channel width to length ratio of the driving transistor.

The threshold voltage $V_{th}$ of the driving transistor may drift due to manufacturing process and aging of devices etc., as a result, the current flowing through the OLED as generated may vary due to drifting of $V_{th}$ even if a same gate-source voltage is applied to the driving transistor, which deteriorates the display effect.

In view of this phenomenon, in the pixel circuit according to the present disclosure, in the second period, the gate and the drain of the driving transistor 16 are short-circuited by the turned-on threshold voltage compensating transistor T8, and the driving transistor forms a diode connection, so that the voltage $V_{th}+V_{data_G}$ is applied to the gate of the driving transistor T6, where $V_{th}$ represents the threshold voltage of the driving transistor T6, and $V_{data_G}$ represents the data signal voltage supplied from the data line; the gate voltage of the driving transistor T6 is maintained until the fourth period, and when the charging transistor T13 is turned on, the source voltage of the driving transistor 16 is VDD, the gate voltage thereof is maintained as $V_{th}+V_{data_G}$, and the gate-source voltage thereof is $V_{gs}=V_{th}+V_{data_G}-VDD$; it can be obtained that $I_{OLED}=K(V_{data_G}-VDD)^2$ when the expression of Vgs=Vth+Vdata_G−VDD is substituted into the above formula for calculating the operating current of the OLED.

It can be seen that, in the sub-pixel unit of the present disclosure, the affect of the threshold voltage of the driving transistor on the operating current of the light emitting element is eliminated by turning on the threshold voltage compensating transistor, thereby enhancing the display effect.

In addition, it should be noted that there exists a time interval, in which the first scan signal Sn, the second scan line Sn−1, the third scan signal Sn+1, and the light emitting control signal En all are at a high level, between the third period and the fourth period, so that the pixel circuit can operate more reliably. In other words, it is ensured that an active driving current is supplied to the second node N2_G after the second initializing transistors T17, T18, and T19 are turned off completely.

Thus, through the four periods illustrated in FIGS. 4*a*-7*b*, the light emitting element is driven to display a single color component, for example, the green component, in the pixel circuit.

The case in which the pixel circuit drives the light emitting element to display a single color component has been described in the above taking the green component as an example, next, the case that the pixel circuit drives the light emitting elements to synchronously display two color components will be described below.

Specifically, specific operations of the pixel circuit illustrated in FIG. 3 will be described in detail with reference to FIGS. 8*a* to 11*b* and taking the case in which the pixel circuit displays the red component and the blue component as an example.

Figure 8A:
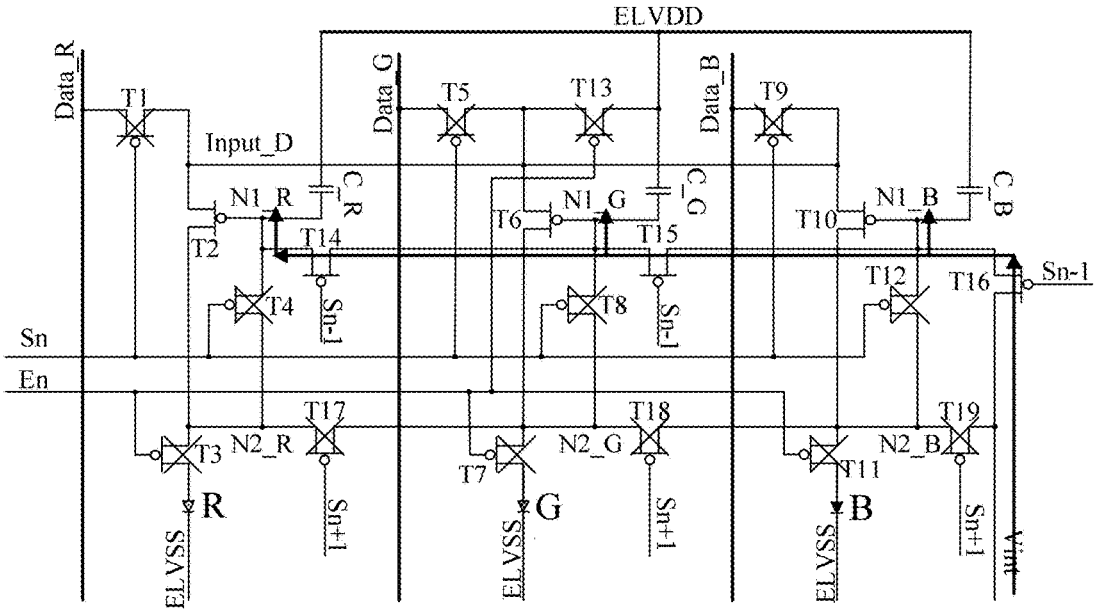
FIGS. 8*a*-11*b* illustrate circuit structure and signal timing in respective periods when a pixel circuit according to an embodiment of the present disclosure drives two sub-pixels synchronously.
Figure 8B:
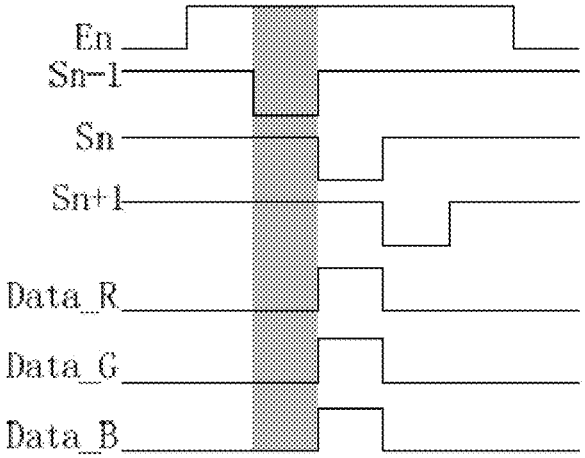

In a first period, as illustrated in FIG. 8*b*, the first scan signal Sn, the third scan signal Sn+1, and the light emitting control signal En are at a high level, and the second scan signal Sn−1 is at a low level; thus, as illustrated in FIG. 8*a*, the transistors T14, T15, and T16 are turned on under control of the second scan signal Sn−1 at a low-level, so that an initializing level inputted from the initializing level input terminal Vint is applied to the node N1_B via the turned-on transistor T16, applied to the node N1_G via the turned-on transistors T16 and T15, and applied to the node N1_R via the turned-on transistors T16, T15, and T14, and thus $V_{N1_R}=V_{N1_G}=V_{N1_B}=$Vint1. Since the initializing level input terminal Vint provides a low level, the first nodes N1 of the respective sub-pixel units are initialized to a low level, so that the driving transistors T2, T6, and T10 whose gates are connected to the first nodes are turned on.

Figure 9A:
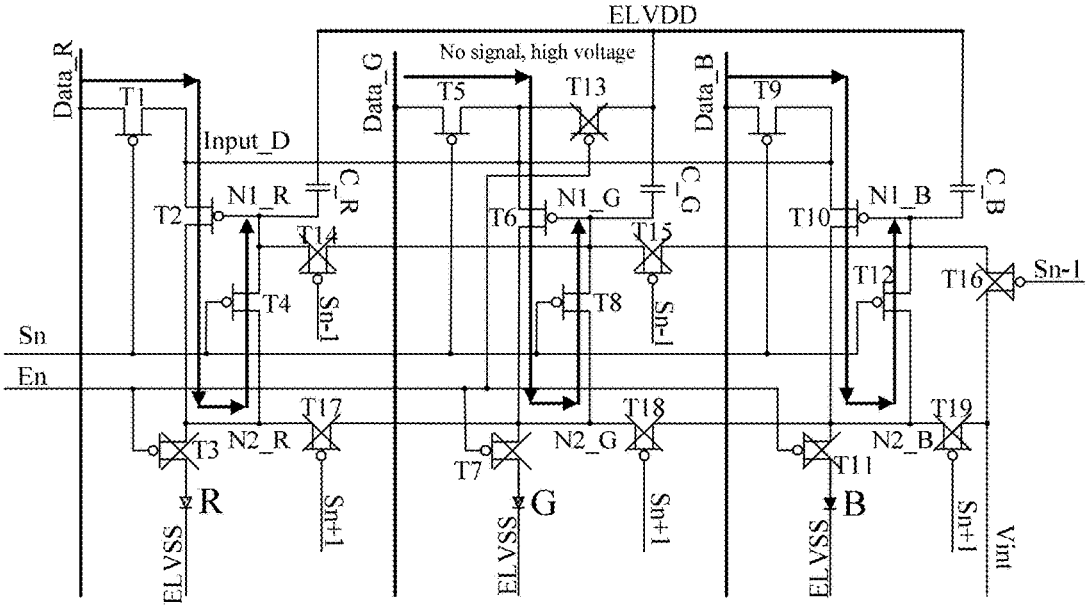
Figure 9B:
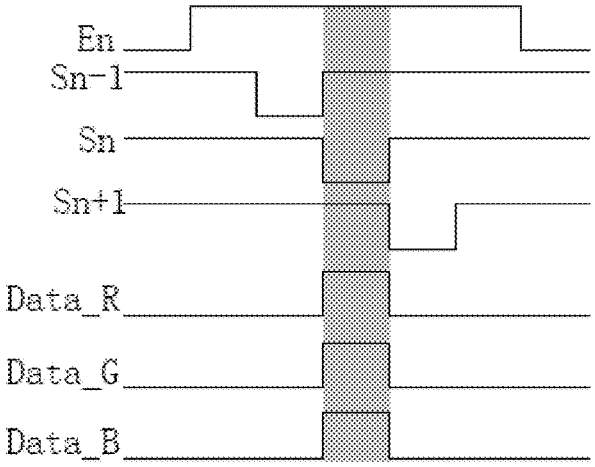

In a second period, as illustrated in FIG. 9*b*, the first scan signal Sn is at a low level, the second scan line Sn−1, the third scan signal Sn+1, and the light emitting control signal En are at a high level; thus, as illustrated in FIG. 9*a*, the transistors T14, T15, and T16 are turned off, and the threshold voltage compensating transistors T4, T8, and T12 are turned on under control of the first scan signal Sn at a low level; the input transistors T1, T5, and T9 are turned on under control of the first scan signal Sn at a low-level, and the driving transistors T2, T6, and T10 are maintained in a turned-on state since the first nodes N1_R, N1_G, and N1_B are still maintained at a low level. As such, the path between the gate and the drain of the driving transistor T2 conducts via the turned-on transistor T4, the path between the gate and the drain of the driving transistor T6 conducts via the turned-on transistor T8, and the path between the gate and the drain of the driving transistor T10 conducts via the turned-on transistor T12. In this example, active data voltage signals are provided on the data lines Data_R and Data_B for the red and blue components respectively, and a high voltage rather than an active data voltage is provided on the data line Data_G for the green component. The voltage at the node N1_R can be expressed as $V_{th}+V_{data_R}$, where $V_{th}$ represents the threshold voltage of the driving transistor T2, $V_{data_R}$ represents the data signal voltage supplied from the data line Data_R, the voltage at the node N1_B can be expressed as $V_{th}+V_{data_B}$, where $V_{th}$ represents the threshold voltage of the driving transistor T10, $V_{data_B}$ represents the data signal voltage supplied from the data line Data_B, so that the affect of the threshold voltage $V_{th}$ of the driving transistor on the light emitting current of the OLED can be removed. Meanwhile, in this period, since the data line Data_G provides a high level, the nodes N1_G is charged to a high level, so that the driving transistors T6 is turned off subsequently.

Figure 10A:
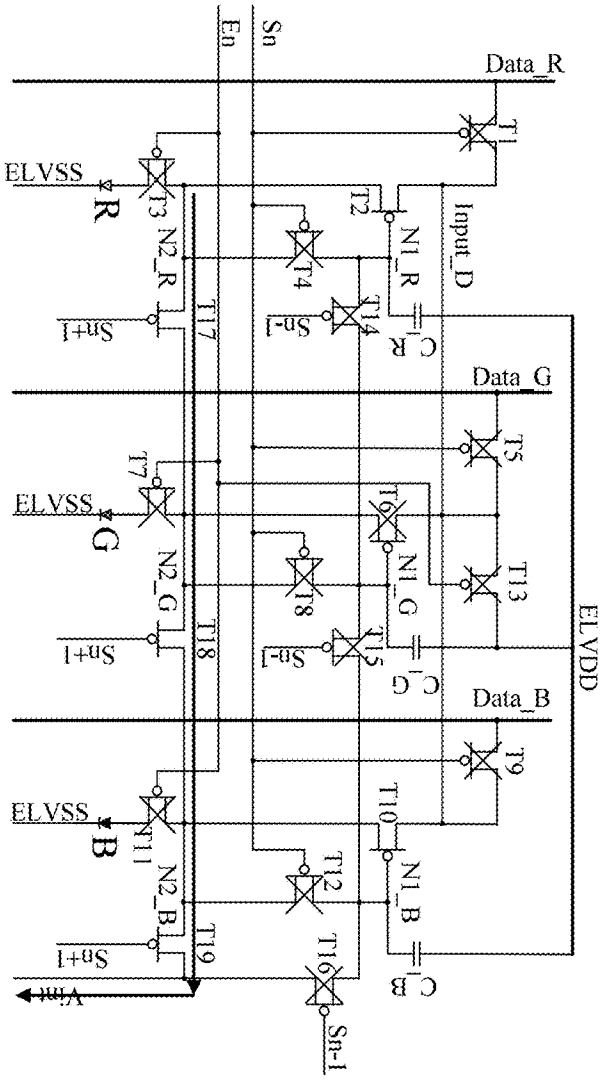
Figure 10B:
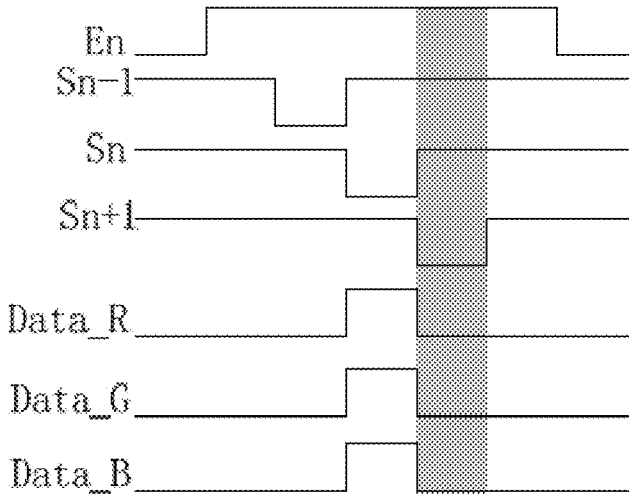

In a third period, as illustrated in FIG. 10*b*, the third scan signal Sn+1 is at a low level, the first scan line Sn, the second scan signal Sn−1, and the light emitting control signal En are at a high level; thus, as illustrated in FIG. 10*a*, the transistors T17, T18, and T19 are turned on, so that an initializing level inputted from the initializing level input terminal Vint is applied to the node N2_B via the turned-on transistor T19, applied to the node N2_G via the turned-on transistors T19 and T18, and applied to the node N2_R via the turned-on transistors T19, T18, and T17, and thus $V_{N2_R}=V_{N2_G}=V_{N2_B}=$Vint2. In this period, the driving transistors T2 and T10 continue to be maintained on. As stated above, initializing the second nodes N2_B, N2_G, and N2_R can enable the light emitting element to be maintained in a dark state before an active light emitting control signal arrives. That is to say, the source potential of the light emitting control transistor can be reduced by applying the low level to the second nodes N2_R, N2_G, and N2_B from the initializing level input terminal Vint via the second initializing transistors T17, T18, and T19 to perform an initialization, thereby effectively reducing or even eliminating the possible leakage current, so that the light emitting element emits no light in a dark state. As described above, when the first node and the second node are initialized, the initializing levels Vint1 and Vint2 provided by the initializing level input terminal can be different from each other depending on the actual situation, so long as it is guaranteed that the driving transistor can be turned on in the first period, and the source potential of the light emitting control transistor can be reduced effectively in the third period to ensure that the light emitting element emits no light.

Figure 11A:
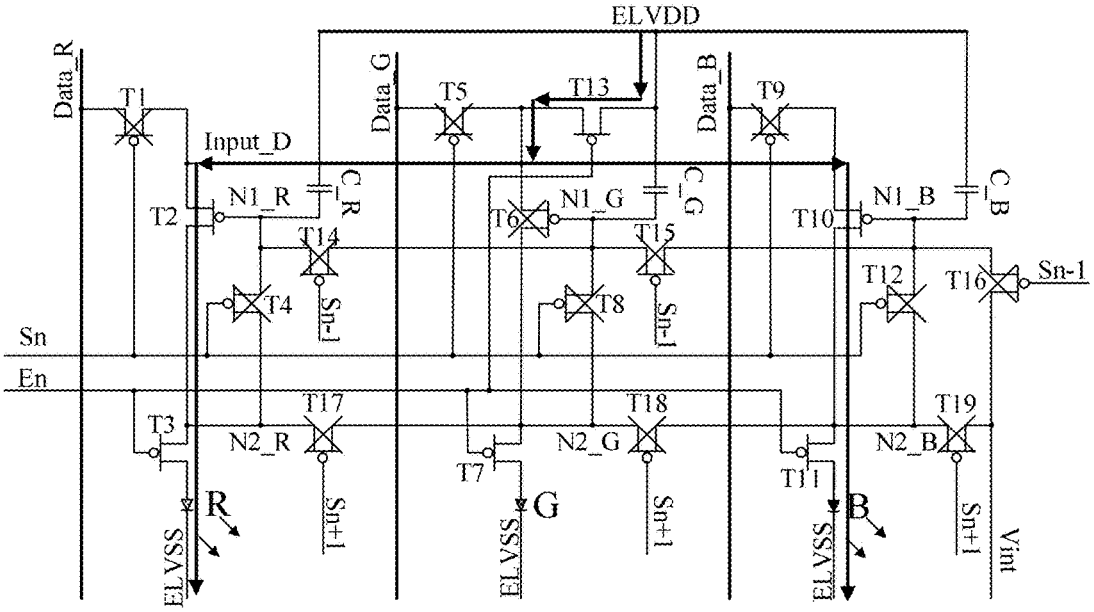
Figure 11B:
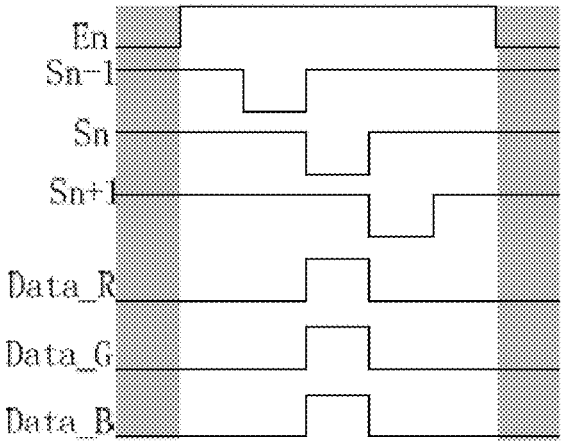

In a fourth period, as illustrated in FIG. 11*b*, the first scan signal Sn, the second scan line Sn−1, and the third scan signal Sn+1 are at a high level, and the light emitting control signal En is at a low level; thus, as illustrated in FIG. 11*a*, the transistors T17, T18, and T19 are turned off, and the light emitting control transistors T3, T7, and T11 are turned on under control of the light emitting control signal at a low-level. Since the level at the first node N1_G is maintained at a high level, the driving transistor T6 is maintained off, and the light emitting elements OLED_G does not emit light; the driving transistors T2 and T10 continue to be maintained on, and the charging transistor T13 is turned on under control of the light emitting control signal at a low level; thereby the charging transistor T13, the driving transistor T2, and the light emitting control transistor T3 form a path through which the driving current can be applied to the light emitting element OLED_R, for driving the light emitting element OLED_R to emit light; meanwhile, the charging transistor T13, the driving transistor T10, and the control transistor T11 form a path through which the driving current can be applied to the light emitting element OLED_B, for driving the light emitting element OLED_B to emit light.

As stated above, it should be noted that there exists a time interval, in which the first scan signal Sn, the second scan line Sn−1, the third scan signal Sn+1, and the light emitting control signal En all are at a high level, between the third period and the fourth period, ensuring that the pixel circuit operates more reliably.

Accordingly, through the four periods illustrated in FIGS. 8*a*-11*b*, the corresponding light emitting elements are driven synchronously to display two color components, for example, the red component and the blue component respectively, in the pixel circuit.

The case in which the pixel circuit drives the light emitting elements to synchronously display two color components has been described in the above taking the read and blue components as an example, next, the case in which the pixel circuit drives the corresponding light emitting elements to synchronously display three color components will be described below.

In this example, the pixel circuit drives the corresponding OLEDs to synchronously display the red, green, and blue components respectively, so as to synthesize other colors, such as white. The operating process of the pixel circuit in the first period is similar to those described in the above with reference to FIGS. 4*a*-4*b* and 8*a*-8*b*, and details will not be repeated here.

Figure 12A:
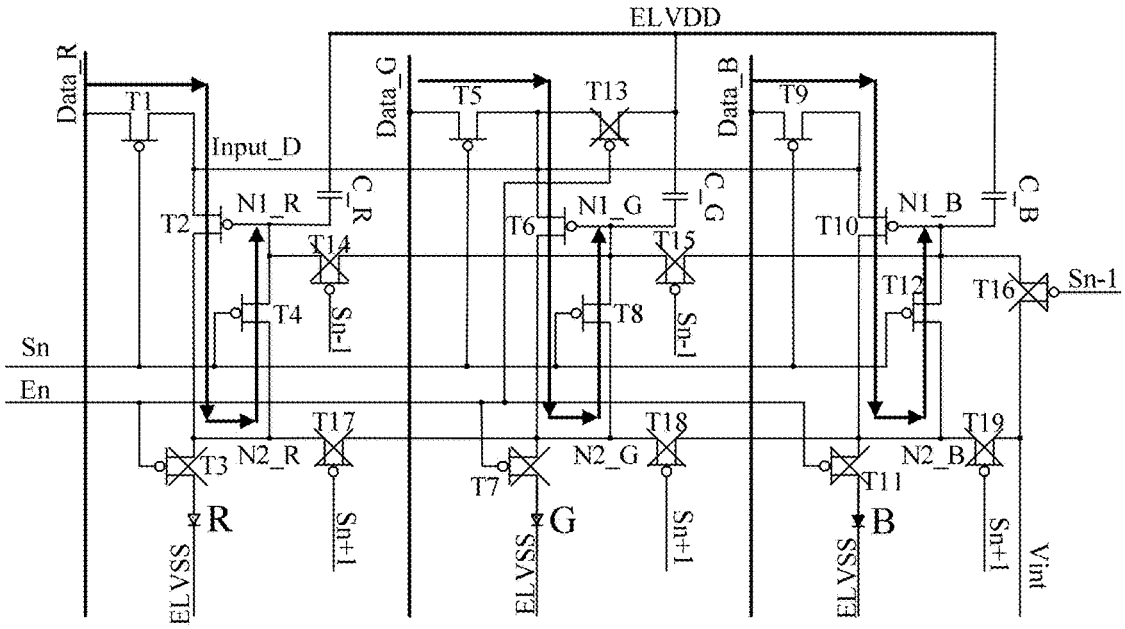
FIGS. 12*a*-14*b* illustrate circuit structure and signal timing in respective periods when a pixel circuit according to an embodiment of the present disclosure drives three sub-pixels synchronously.
Figure 12B:
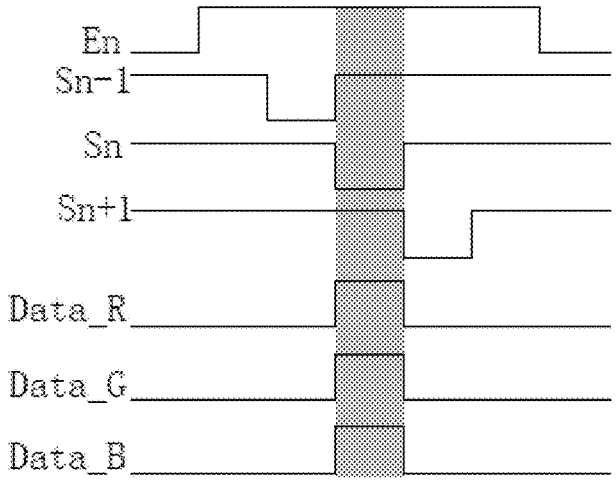

In a second period, as illustrated in FIG. 12*b*, the first scan signal Sn is at a low level, the second scan line Sn−1, the third scan signal Sn+1, and the light emitting control signal En are at a high level; thus, as illustrated in FIG. 12*a*, the transistors T14, T15, and T16 are turned off, and the threshold voltage compensating transistors T4, T8, and T12 are turned on under control of the first scan signal Sn at a low-level, and the input transistors T1, T5, and T9 are turned on under control of the first scan signal Sn at a low-level; the driving transistors T2, T6, and T10 are maintained on since the first nodes N1_R, N1_G, and N1_B are still maintained at a low level. As such, the path between the gate and the drain of the driving transistor T2 conducts via the turned-on transistor T4, the path between the gate and the drain of the driving transistor T6 conducts via the turned-on transistor T8, and the path between the gate and the drain of the driving transistor 110 conducts via the turned-on transistor T12. In this example, active data voltage signals are provided on the data lines Data_R, Data_G, and Data_B for the red, green, and blue components respectively. The voltage at the node N1_G can be expressed as $V_{th}+V_{data_G}$, and the voltage at the node N1_B can be expressed as $V_{th}+V_{data_B}$, where $V_{th}$ represents the threshold voltage of the respective driving transistor, Vdata_R represents the data signal voltage supplied from the data line Data_R, $V_{data_G}$ represents the data signal voltage supplied from the data line Data_G, and $V_{data_B}$ represents the data signal voltage supplied from the data line data_B, so that the affect of the threshold voltage $V_{th}$ of the driving transistor on the light emitting current of the OLED can be removed.

Figure 13A:
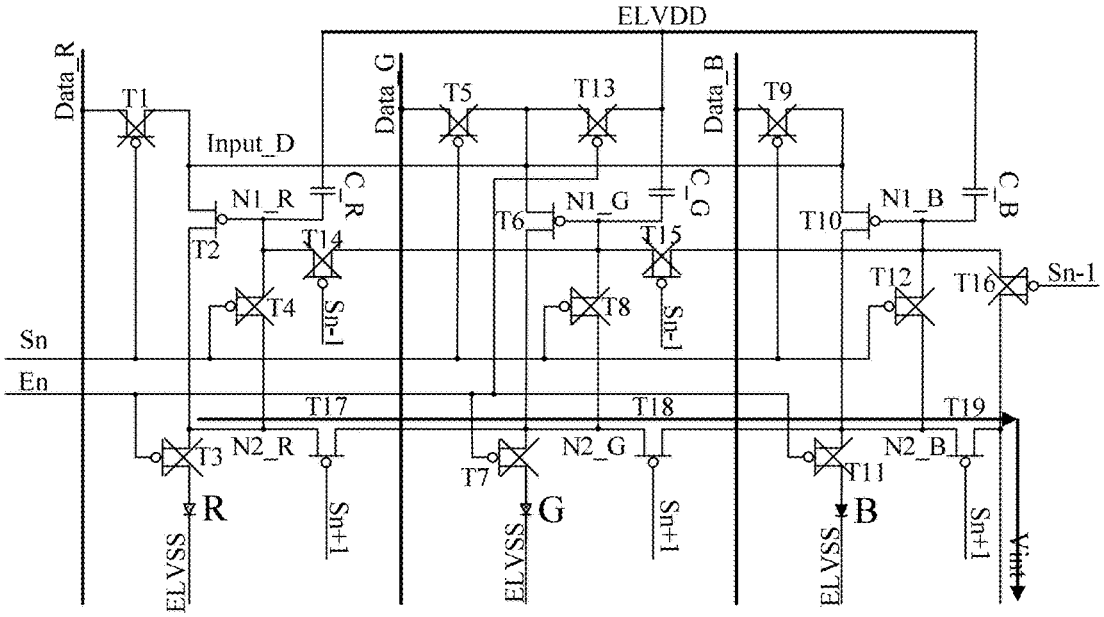
Figure 13B:
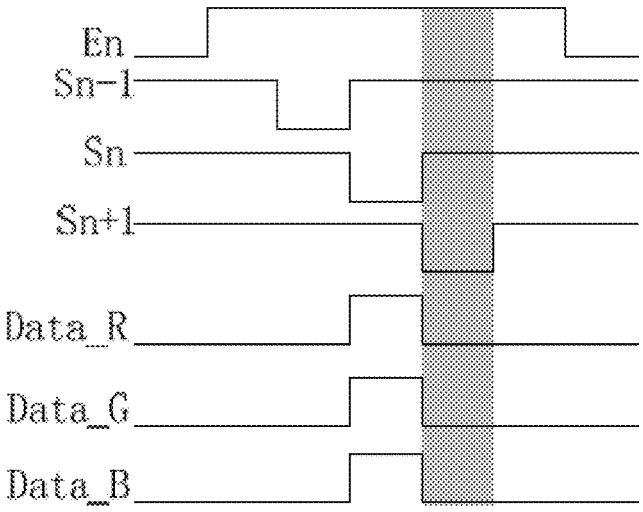

In a third period, as illustrated in FIG. 13*b*, the third scan signal Sn+1 is at a low level, the first scan line Sn, the second scan signal Sn−1, and the light emitting control signal En are at a high level; thus, as illustrated in FIG. 13*a*, the transistors T17, T18, and T19 are turned on, so that an initializing level inputted from the initializing level input terminal Vint is applied to the node N2_B via the turned-on transistor T19, applied to the node N2_G via the turned-on transistors T19 and T18, and applied to the node N2_R via the turned-on transistors T19, T18, and T17, and thus $V_{N2_R}=V_{N2_G}=V_{N2_B}=$Vint2; in this period, the driving transistors T2, T6, and T10 are maintained in a turned-on state.

Figure 14A:
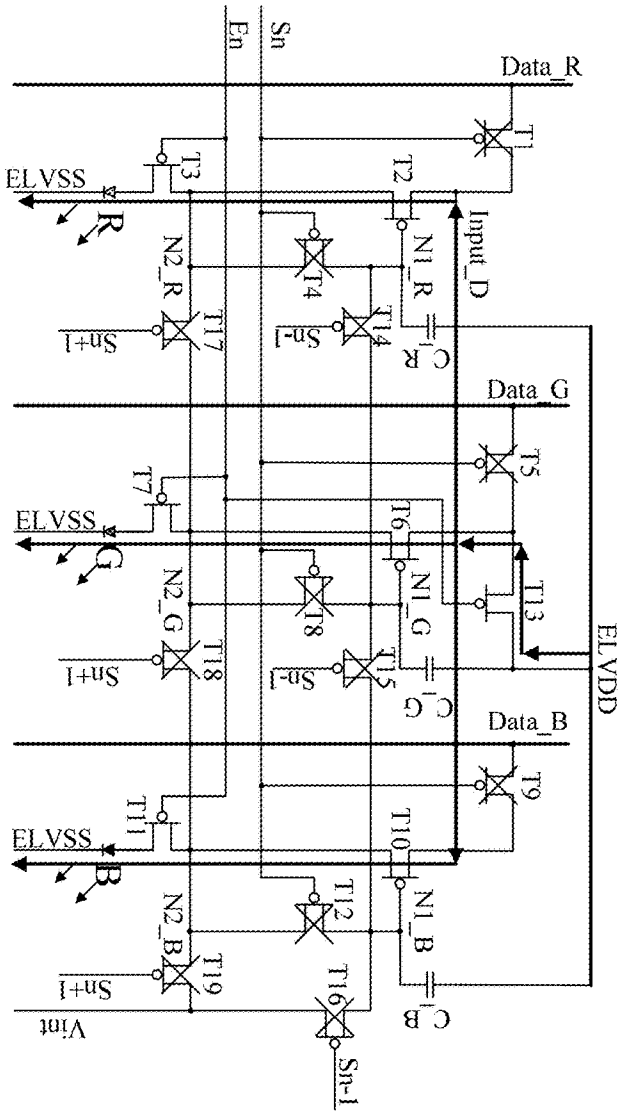
Figure 14B:
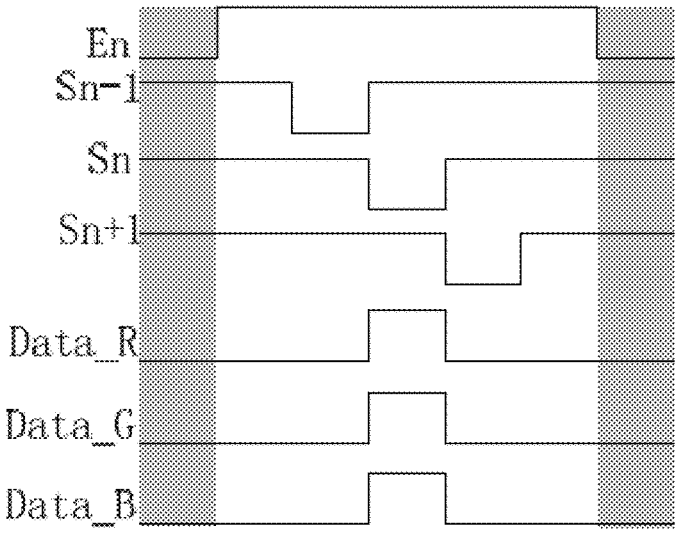
Figure 15:
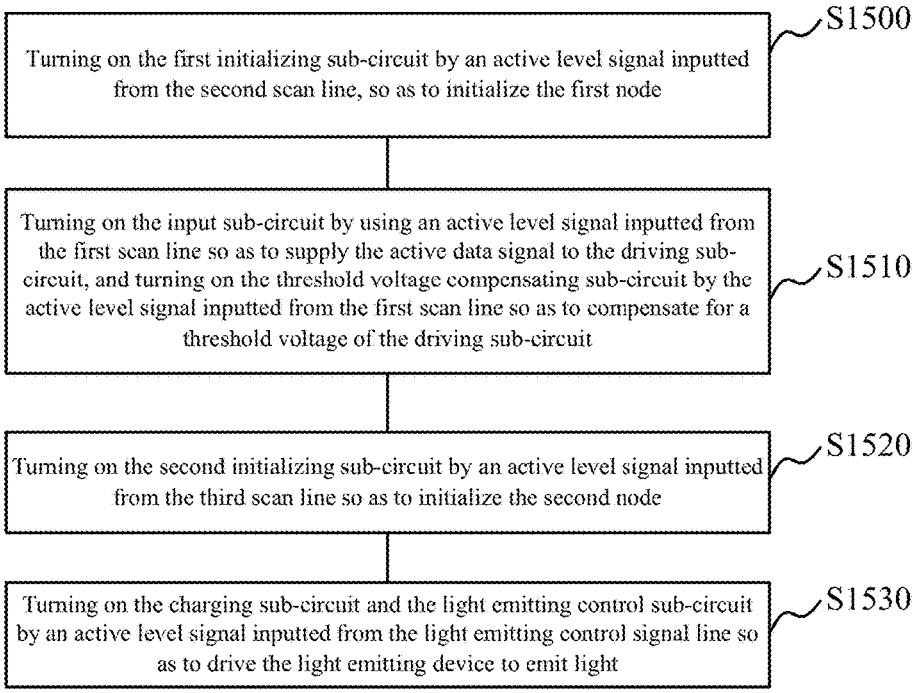
FIG. 15 is a flowchart of a driving method applied to a pixel circuit according to an embodiment of the present disclosure.

In a fourth period, as illustrated in FIG. 14*b*, the first scan signal Sn, the second scan line Sn−1, and the third scan signal Sn+1 are at a high level, and the light emitting control signal En is at a low level; thus, as illustrated in FIG. 14*a*, the transistors T17, T18, and T19 are turned off, and the light emitting control transistors T3, T7, and T11 are turned on under control of the light emitting control signal at a low-level; the driving transistors T2, T6, and T10 continue to be maintained on, and the charging transistor T13 is turned on under control of the light emitting control signal at a low-level; thereby the charging transistor T13, the driving transistor T2, and the light-emitting control transistor T3 form a path through which the driving current can be applied to the light emitting element OLED_R, for driving the light emitting element OLED_R to emit light; meanwhile, the charging transistor T13, the driving transistor T6, and the light-emitting control transistor T7 form a path through which the driving current can be applied to the light emitting element OLED_G, for driving the light emitting element OLED_G to emit light; meanwhile, the charging transistor T13, the driving transistor T10, and the light-emitting control transistor T11 form a path through which the driving current can be applied to the light emitting element OLED_B, for driving the light emitting element OLED_B to emit light.

Accordingly, through the four periods illustrated above, the corresponding light emitting elements are driven to synchronously display three color components respective, for example, the red component, the green component, and the blue component, in the pixel circuit.

The pixel circuit according to the present disclosure integrates a plurality of sub-pixels for separately driving a single color component, so that the plurality of sub-pixels can be driven concurrently; in other words, corresponding light emitting elements can be driven concurrently to display the respective color components, the respective sub-pixel units can share certain driving signals, so that the number of driving signals is reduced, wiring space of the driving circuit is saved, and system integration is improved. In addition, delays among the corresponding driving signals for displaying adopted by the respective sub-pixel circuits are eliminated, and a display quality at the time of using the respective sub-pixels to display and thereby synthesizing colors is improved. Meanwhile, it is possible to arrange more pixel dots in a case in which a size of the display panel is fixed, and thereby resolution of the display panel is increased. Further, the compensation mechanism is introduced in the respective sub-pixel circuits, so that threshold voltages of the driving transistors in the sub-pixel units can be compensated and response characteristics of the OLEDs can be improved.

According to another aspect of the present disclosure, there is provided an array substrate, on which a plurality of the pixel circuits described above are arranged for driving light emitting elements for displaying.

According to a yet another aspect of the present disclosure, there is provided a display device comprising the array substrate described above. The display device can be any product or component having a display function such as AMOLED display, television, digital photo frame, mobile phone, tablet computer, and so on.

According to a still another aspect of the present disclosure, there is provided a driving method applied to the pixel circuit described above, comprising: turning on the first initializing sub-circuit by an active level signal inputted from the second scan line, so as to initialize the first node; turning on the input sub-circuit by an active level signal inputted from the first scan line so as to supply an active data signal to the driving sub-circuit, and turning on the threshold voltage compensating sub-circuit by the active level signal inputted from the first scan line so as to compensate for a threshold voltage of the driving sub-circuit; turning on the second initializing sub-circuit by an active level signal inputted from the third scan line so as to initialize the second node; and turning on the charging sub-circuit and the light emitting control sub-circuit by an active level signal inputted from the light emitting control signal line, so as to drive the light emitting element to emit light.

Optionally, the driving method according to the present disclosure as described above further comprises: when an active level signal is inputted to the first scan line, supplying active data signals corresponding to respective color components to the driving sub-circuits of the sub-pixel units separately or synchronously via the corresponding data lines.

Optionally, the driving method according to the present disclosure as described above further comprises: when an active level signal is inputted to the first scan line, supplying an active data signal corresponding to a single color component to the driving sub-circuit of the sub-pixel unit via the corresponding data line.

Optionally, the driving method according to the present disclosure as described above further comprises: when an active level signal is inputted to the first scan line, supplying active data signals corresponding to two color components to the driving sub-circuits of the sub-pixel units synchronously via the corresponding data lines.

Optionally, the driving method according to the present disclosure as described above further comprises: when an active level signal is inputted to the first scan line, supplying active data signals corresponding to three color components to the driving sub-circuits of the sub-pixel units synchronously via the corresponding data lines.

Optionally, the driving method according to the present disclosure as described above further comprises: when an active data signal is supplied to the driving sub-circuit of the sub-pixel unit via the data, turning on the threshold voltage compensating sub-circuit via the active level signal inputted from the first scan line, and applying a sum of the active data signal and the threshold voltage of the driving sub-circuit to the control terminal of the driving sub-circuit.

To sum up, in the pixel circuit and the driving method according to the embodiment of the present disclosure, since driving of a plurality of sub-pixels is integrated into one pixel driving circuit, the respective sub-pixels can share certain driving signals, so that the number of driving signals is reduced, wiring space of the driving circuit is saved, and system integration is improved. In addition, delays among the corresponding driving signals adopted by the respective sub-pixel circuits for displaying are eliminated, and a display quality at the time of using the respective sub-pixels to display and thereby synthesizing colors is improved. Meanwhile, with the pixel circuit and the driving method of the present embodiment, it is possible to arrange more pixel dots in a case in which a size of the display panel is fixed, thereby increasing the resolution of the display panel.

In addition, in the pixel circuit and the driving method according to the embodiment of the present disclosure, when the data voltage is applied to the driving sub-circuit, the threshold voltage of the driving sub-circuit is compensated by the threshold voltage compensation sub-circuit, and the affect of the threshold voltage of the driving transistor on the operating current of the light emitting element is eliminated, thereby enhancing the display effect.

In addition, in the pixel circuit and the driving method according to the embodiment of the present disclosure, the second node is initialized by the second initializing sub-circuit before the driving current is applied to the light emitting element, so that a leakage current of the light emitting control sub-circuit is eliminated, and the light emitting element is prevented from emitting light in a dark state due to the leakage current, thus improving the display quality.

Some specific embodiments have been described above. But it should be understood that modifications can be made to these embodiments. For example, elements of different embodiments can be combined, supplemented, modified, and deleted to obtain other embodiments. In addition, it will be understood by those of ordinary skill in the art that other structures and processes can be used in place of the structures and processes that have been disclosed above to obtain other embodiments. The other embodiments at least act substantially the same function in substantially the same way, so as to achieve substantially the same effect provided by the embodiments disclosed in the present disclosure. Accordingly, these and other embodiments should be within the scope of the present disclosure.

2) The present application claims priority of the Chinese Patent Application No. 201610214028.4 filed on Apr. 7, 2016, the entire disclosure of which is hereby incorporated in full text by reference as part of the present application.

What is claimed is:

1. A pixel circuit, comprising a plurality of sub-pixel units each of which comprises an input sub-circuit, a driving sub-circuit, a light emitting control sub-circuit, and a level maintaining sub-circuit, wherein the input sub-circuit is connected to a data line and configured to supply a data signal on the data line to an input terminal of the driving sub-circuit under control of a first scan line;

the driving sub-circuit is configured to receive the data signal inputted from the input sub-circuit and output a driving current to the light emitting control sub-circuit via a second node under control of a first node;

the light emitting control sub-circuit is configured to drive a light emitting element to emit light according to the received driving current under control of a light emitting control line; and the level maintaining sub-circuit is connected between the first node and a first voltage terminal and is configured to maintain a level at the first node, wherein respective sub-pixel units are connected to the first voltage terminal via a charging sub-circuit comprising a thirteenth transistor, wherein a first electrode of the thirteenth transistor is connected to the first voltage terminal, a control electrode of the thirteenth transistor is connected to the light emitting control line, and a second electrode of the thirteenth transistor is connected to the input terminal of the driving sub-circuit.

2. The pixel circuit according to claim 1, wherein each sub-pixel unit further comprises:

a threshold voltage compensating sub-circuit connected between the first node and the second node, and configured to compensate for a threshold voltage of the driving sub-circuit under control of the first scan line.

3. The pixel circuit according to claim 2, wherein the threshold voltage compensating sub-circuit comprises a fourth transistor;

wherein a gate of the fourth transistor is connected to the first scan line, a first electrode of the fourth transistor is connected to the first node, and a second electrode of the fourth transistor is connected to the second node.

4. The pixel circuit according to claim 1, wherein each sub-pixel unit further comprises:

a first initializing sub-circuit configured to initialize the first node under control of a second scan line;

wherein respective sub-pixel units are connected to an initializing level input terminal via first initializing sub-circuits connected in series with each other.

5. The pixel circuit according to claim 4, wherein the first initializing sub-circuit comprises a fourteenth transistor;

wherein a control electrode of the fourteenth transistor is connected to the second scan line, and a first electrode of the fourteenth transistor is connected to the first node; and the first initializing sub-circuit is configured to initialize the first node under control of the second scan line.

6. The pixel circuit according to claim 1, wherein each sub-pixel unit further comprises:

a second initializing sub-circuit configured to initialize the second node under control of a third scan line;

wherein respective sub-pixel units are connected to an initializing level input terminal via second initializing sub-circuits connected in series with each other.

7. The pixel circuit according to claim 6, wherein the second initializing sub-circuit comprises a seventeenth transistor, a control electrode of the seventeenth transistor is connected to the third scan line, and a first electrode of the seventeenth transistor is connected to the second node; and the second initializing sub-circuit is configured to initialize the second node under control of the third scan line.

8. The pixel circuit according to claim 1, wherein the input sub-circuit comprises a first transistor;

wherein a first electrode of the first transistor is connected to the data line, a control electrode of the first transistor is connected to the first scan line, and a second electrode of the first transistor is connected to the input terminal of the driving sub-circuit.

9. The pixel circuit according to claim 1, wherein the driving sub-circuit comprises a second transistor; wherein a first electrode of the second transistor is configured to serve as the input terminal of the driving sub-circuit, a control electrode of the second transistor is connected to the first node, and a second electrode of the second transistor is connected to the second node.

10. The pixel circuit according to claim 1, wherein the light emitting control sub-circuit comprises a third transistor;

wherein a first electrode of the third transistor is connected to the second node, a control electrode of the third transistor is connected to the light emitting control line, and a second electrode of the third transistor is connected to the light emitting element.

11. The pixel circuit according to claim 1, wherein the level maintaining sub-circuit comprises a first capacitor;

wherein a first terminal of the first capacitor is connected to the first node, and a second terminal of the first capacitor is connected to the first voltage terminal.

12. A driving method applied to the pixel circuit according to claim 1, comprising:

turning on the first initializing sub-circuit by an active level signal inputted from the second scan line, so as to initialize the first node;

turning on the input sub-circuit by an active level signal inputted from the first scan line so as to supply an active data signal to the driving sub-circuit, and turning on the threshold voltage compensating sub-circuit by the active level signal inputted from the first scan line so as to compensate for a threshold voltage of the driving sub-circuit;

turning on the second initializing sub-circuit by an active level signal inputted from the third scan line so as to initialize the second node; and turning on the charging sub-circuit and the light emitting control sub-circuit by an active level signal inputted from the light emitting control signal line so as to drive the light emitting element to emit light.

13. The driving method according to claim 12, further comprising:

when the active level signal is inputted to the first scan line, supplying active data signals corresponding to respective color components to the driving sub-circuits of the sub-pixel unit separately or synchronously via corresponding data lines.

14. The driving method according to claim 12, further comprising:

when the active data signal is supplied to the driving sub-circuit of the sub-pixel unit via the data line, turning on the threshold voltage compensating sub-circuit via the active level signal inputted from the first scan line, and applying a sum of the active data signal and the threshold voltage of the driving sub-circuit to the control terminal of the driving sub-circuit.

15. An array substrate, on which a plurality of pixel circuits each according to claim 1 are arranged for driving light emitting elements for displaying.

16. The array substrate according to claim 15, wherein each sub-pixel unit further comprises:

a threshold voltage compensating sub-circuit connected between the first node and the second node, and configured to compensate for a threshold voltage of the driving sub-circuit under control of the first scan line.

17. The array substrate according to claim 15, wherein each sub-pixel unit further comprises:

a first initializing sub-circuit configured to initialize the first node under control of a second scan line;

wherein respective sub-pixel units are connected to an initializing level input terminal via first initializing sub-circuits connected in series with each other.

18. The array substrate according to claim 15, wherein each sub-pixel unit further comprises:

a second initializing sub-circuit configured to initialize the second node under control of a third scan line;

wherein respective sub-pixel units are connected to an initializing level input terminal via second initializing sub-circuits connected in series with each other.

* * * * *